US005301865A

United States Patent [19]

Klamma et al.

[11] Patent Number: 5,301,865

[45] Date of Patent: Apr. 12, 1994

[54] STRIP STORAGE UNIT FOR A CONTINUOUS OPERATION OF ROLLING MILL TRAINS

[75] Inventors: Klaus Klamma, Hilchenbach; Withold Richert, Hückelhoven, both of Fed. Rep. of Germany

[73] Assignee: SMS Schloemann-Siemag Aktiengesellschaft, Dusseldorf, Fed. Rep. of Germany

[21] Appl. No.: 975,208

[22] Filed: Nov. 12, 1992

Related U.S. Application Data

[63] Continuation of Ser. No. 793,489, Nov. 13, 1991, abandoned, which is a continuation of Ser. No. 497,856, Mar. 22, 1990, abandoned.

[30] Foreign Application Priority Data

Mar. 22, 1989 [DE] Fed. Rep. of Germany ..... 3909403

[51] Int. Cl.[5] ..... B65H 20/24

[52] U.S. Cl. ..... 226/118; 226/113

[58] Field of Search ..... 226/113, 118; 254/374

[56] References Cited

U.S. PATENT DOCUMENTS

| | | | |
|---|---|---|---|
| 12,214 | 1/1855 | Nichols | 254/374 |
| 2,817,447 | 12/1957 | Bianca | 254/374 X |
| 3,130,888 | 4/1964 | Rothfuss et al. | 226/113 |
| 3,515,327 | 6/1970 | Bortmas | 226/113 |
| 3,687,348 | 8/1972 | Schieb | 226/118 X |
| 4,391,400 | 7/1983 | Sylvain | 226/113 |
| 4,899,988 | 2/1990 | Mills | 254/374 X |

FOREIGN PATENT DOCUMENTS

| | | | |
|---|---|---|---|
| 0299103 | 6/1972 | Austria . | |
| 0110864 | 8/1984 | Austria . | |
| 1953169 | 10/1969 | Fed. Rep. of Germany . | |
| 4643975 | 10/1968 | Japan | 226/113 |

*Primary Examiner*—Daniel P. Stodola
*Assistant Examiner*—Paul T. Bowen
*Attorney, Agent, or Firm*—Anderson Kill Olick & Oshinsky

[57] ABSTRACT

A strip storage unit for a continuous operation of rolling mill trains, particularly a loop-forming strip storage unit for sheet metal strips in strip treatment plants. The strip storage unit includes a loop carriage having at least one deflection roller for a strip loop. The loop carriage is movable on guides for changing the length of the loop. Support carriages which are also movable on guides and are provided with at least one support roller each are connected to the loop carriage through traction members, such as, ropes, chains or the like. The storage unit further includes at least one feed roller and a run-out roller for the strip. At least one cam drum is arranged at each support carriage. The traction members travel on the surfaces of the drum. For maintaining an equal distance between the loop carriage and the adjacent support carriage and between the support carriages when the loop carriage is moved by a certain distance, a torque motor acts on each cam drum.

6 Claims, 2 Drawing Sheets

STRIP STORAGE UNIT FOR A CONTINUOUS OPERATION OF ROLLING MILL TRAINS

This is a continuation of application Ser. No. 793,489 filed Nov. 13, 1991, now abandonded which itself is a continuation of application Ser. No. 07/497,856, filed Mar. 22, 1990, now abandoned.

BACKGROUND OF THE INVENTION

1. Field of the Invention

The present invention relates to a strip storage unit for a continuous operation of rolling mill trains, particularly a loop-forming strip storage unit for sheet metal strips in strip treatment plants. The strip storage unit includes a loop carriage having at least one deflection roller for a strip loop. The loop carriage is movable on guides for changing the length of the loop. Support carriages which are also movable on guides and are provided with at least one support roller for the strip are connected to the loop carriage through traction members, such as, ropes, chains or the like. The strip storage unit further includes at least one feed roller and a run-out roller for the strip.

2. Description of the Related Art

Strip storage units for rolled strip are necessary for the continuous operation of rolling mill stands in rolling mill trains. Strip storage units are also required when individual coils which must be connected to each other before being introduced into the rolling mill train, are to be fed to the rolling mill train or rolling mill stand and are to be rolled in the stand. In order to avoid a slowdown of the rolling speed or even an interruption of the operation of the rolling mill train or the rolling mill stands, a loop-type storage unit and a loop forming unit of some type must be provided whose capacity is such that the strip can still be continuously fed to the rolling mill stand or rolling mill train if the individual coils must be prepared for welding together. Similar considerations are applicable to other plants which process metal strip, for example, pickling plants or annealing furnaces, which must be operated continuously and in which the different speeds of the strips being introduced must be compensated. Depending on the available space, looping towers, looping pits or horizontally extending loopers are used.

Horizontally extending loopers or horizontally arranged strip storage units are known in the art, particularly from German Offenlegungsschrift 1,953,169, Austrian patent 299,103 and European patent application 0,110,864.

The horizontally extending looper according to according to German Offenlegungsschrift 1,953,169 for strip processing plants with loop carriage and support rollers is characterized in that the support rollers are supported in several so-called trailers which are movable in horizontal direction. The ropes which connect the trailers and the loop carriage are wound onto drums and are kept in constant tension by the drives of the drums. When the loop carriage is moved in order to shorten the length of the supply loop, the loop carriage pushes the trailers ahead. Accordingly, the restoring force exerted by the rope drum drive merely has the purpose to keep the connecting ropes in a tensioned state, so that each following trailer is moved by the loop carriage only when the rope length between the loop carriage and the respective trailer has been used up. When the rope drum is driven by a spring drum, there is the disadvantage that the springs have only a service life of a few months. If the rope drums are driven electrically, there is the disadvantage that each motor must have its own control and its own energy supply.

The horizontal strip storage unit for sheet metal strips according to Austrian patent 299,103, includes a movable loop carriage which is preferably drivable with a constant torque for increasing the length of the loop and a plurality of support carriages which are movable along guide rails. An endless rope guided around deflection rollers is connected to the loop carriage and the support carriages. The drive of the support carriages is provided by the rope through receiving rollers with the intermediate arrangement of reduction transmission units, so that there is an equal spacing between the support carriages when the loop carriage is moved. This strip storage unit has the particular disadvantage that a different transmission ratio is required for each carriage and that there is the danger that dirt accumulates on the drive pinion and the rack, so that the drive and transmission conditions are not exact.

The horizontal strip storage unit according to European application 0,110,864 also includes a movable loop carriage which is coupled with individual support carriages by means of flexible traction members which can be pulled out against a restoring force. The traction members have to be elastically expandable at least over a certain length. The traction members are, for example, rubber ropes or the like, and are guided around deflection rollers to form a loop. The purpose of this construction is to provide an impact-free drive of the support carriage by the loop carriage, while simultaneously ensuring a uniform distance between the individual support carriages. This strip storage unit has the disadvantage that the flexible or elastic rubber ropes age relatively quickly and become brittle and, therefore, can wear in an uncontrolled manner and at a different rate, and that rubber ropes can be damaged relatively quickly in the demanding rolling mill operation, so that there is also the danger that the rubber ropes will break.

It is, therefore, the primary object of the present invention to provide a strip storage unit in which the above-described disadvantages are avoided and in which the connections between the support carriages and the loop carriage are substantially more durable. When the loop carriage is moved in order to change the length of the loop, the distances between the support carriages are to remain equal, so that an optimum guidance of the strip on the support rollers of the support carriages is ensured. In addition, the movement of the support carriages is to be without impact.

SUMMARY OF THE INVENTION

In accordance with the present invention, the strip storage unit of the above-described type includes at least one cam drum arranged at each support carriage; each cam drum interacts with a torque resistance; and the traction member travels on the surface of the drum.

The strip storage unit according to the present invention has the advantage that the strip is supported continuously and in an optimum manner by the support rollers of the support carriages during filling of the storage unit as well as during emptying of the storage unit. Also, no impact-like loads act on the support carriages when the loop carriage is moved. In addition, the system is very reliable because of the possibility of using steel ropes having a high load bearing capacity, because of the arrangement of cam drums and because of the preferred use of a torque motor.

The torque motor may be relatively small because it only has to overcome the friction torques. Also, when the loop carriage is moved back, the support carriages maintain equal distances between each other. The combination of the torque motor and the cam drum results in a rope traction which depends directly proportionally on the length of the rope.

In accordance with a further development of the invention, the cam drum has an ascending contour onto which the traction member can be wound or from which the traction member can be unwound when the loop carriage is moved. Such a contour can be particularly inexpensively manufactured. Preferably, the contour may be a conical drum. In accordance with an advantageous further development, the cam drum may have a short cylindrical portion and an adjacent ascending drum contour. The conical portion of the drum should preferably have a diameter ratio of 1:3 to 1:3.5.

In accordance with another further development of the invention, the conical drum contour has helically extending grooves in which the rope is received, so that an exact guidance of the traction rope on the cone is ensured and the predetermined distances between the support carriages is ensured during the displacement thereof. It is useful if the drum is surrounded by a spaced-apart hood of corresponding shape, wherein the traction rope runs between the drum contour and the hood. An exact guidance of the rope on the cam drum may also be achieved by connecting the cam drum through a gear unit with a guide arrangement for the traction rope to be guided on the drum contour. As a result, rope displacements, rope loops or intersecting rope on the cam drums can be safely prevented. When steel ropes of high load bearing capacity are used as traction members, the above-described features according to the present invention permit an exact and very reliable distance guidance between the support carriages, so that the strip storage unit operates without problems and without maintenance even in difficult operating conditions in the rolling mill.

In accordance with a preferred feature of the invention, the torque motor and the corresponding cam drum are arranged in the region of the truck of the support carriage, preferably on the level of the wheel axes of the support of the support carriages. The torque motor has electrical contact with a current-supplying rail arranged in the foundation and between the wheel guides or with a catenary cable. In this case, the cam drum and support motor are advantageously arranged in the middle of the axis, so that the transverse forces acting on the support carriages during the displacement are as low as possible.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
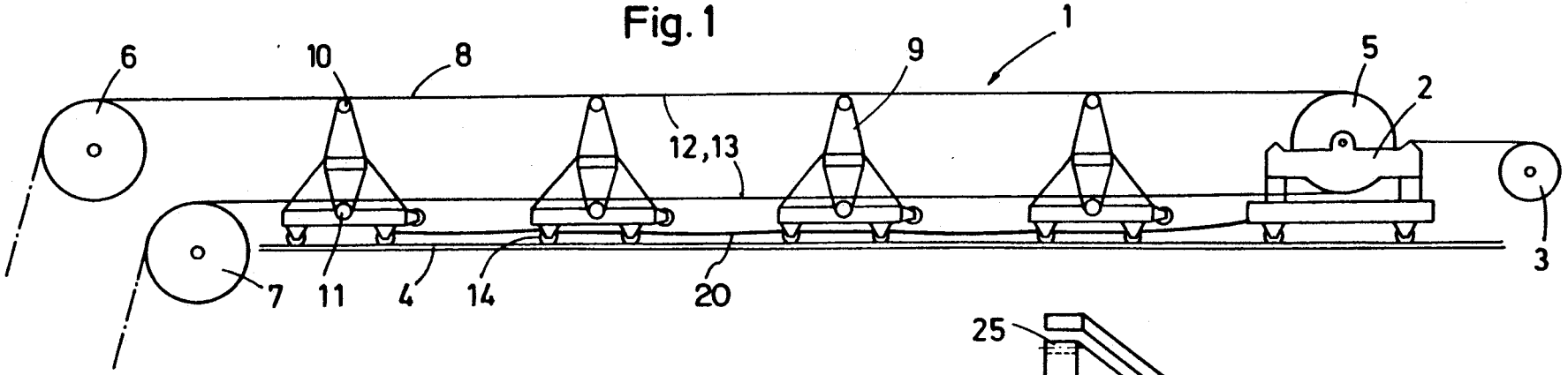
FIG. 1 is a schematic side view of a strip storage unit according to the present invention.

As illustrated in FIG. 1 of the drawing, the strip storage unit 1 includes a loop carriage 2 which is moved on rails 4 by means of a motor-driven rope winch 3. The loop carriage 2 has a deflection roller 5. A feed roller 6 and a run-out roller 7 for the sheet metal strip 8 to be stored are arranged at the input or output of the strip storage unit. Several support carriages 9 are arranged between the feed roller 6 and the run-out roller 7 and the loop carriage 2. The support carriages 9 have support rollers 10, 11 for the sheet metal strip which is guided on the support rollers 10, 11 as an upper strip portion 12 and a lower strip portion 13. The support carriages 9 have wheels 14 which run on rails 4.

Figure 2:
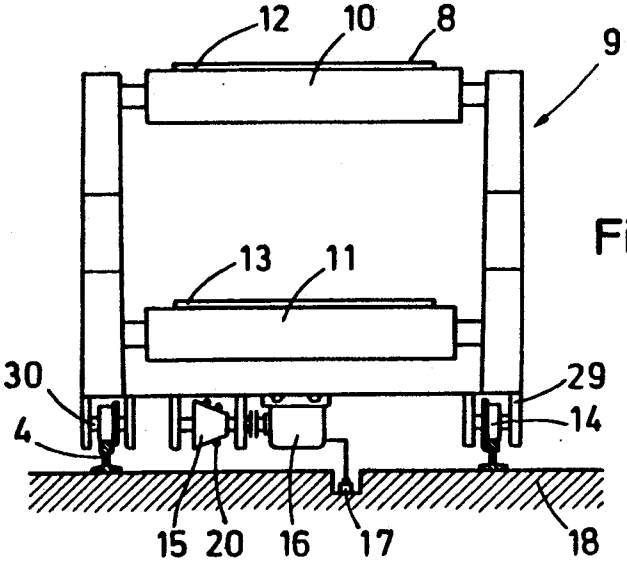
FIG. 2 is a front view of a support carriage with cam drum and torque motor.

As shown in FIG. 2, a cam drum 15 with torque motor 16 is arranged in the region of the truck 29 of the support carriage 9. The torque motor 16 is in contact with a current-carrying rail 17 arranged between the guide rails in the foundation 18. A catenary cable, not shown, may also be used for supplying current to the torque motor 16.

Figure 3:
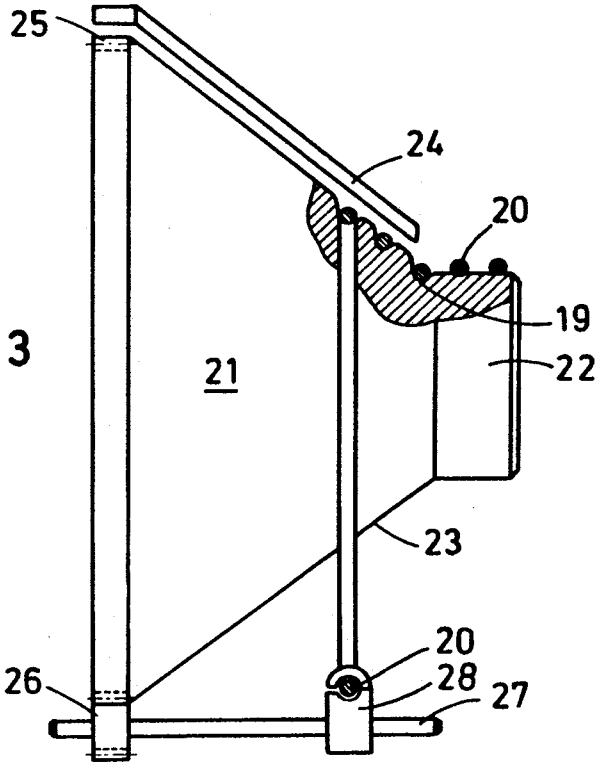
FIG. 3 is a view of a cam drum with a rope guiding device.
Figure 4:
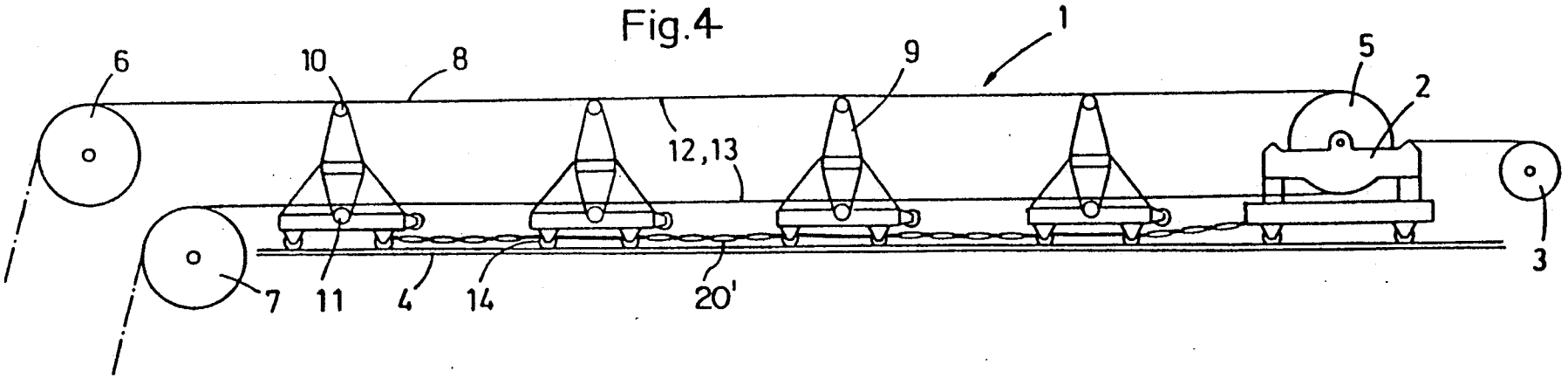
FIG. 4 is a schematic view of a strip storage unit having a chain as the traction member.

As shown in FIG. 3, the cam drum 15 has a conical portion 21. The cam drum 15 has grooves 19 which recieve a traction rope 20 or chain 20 as shown in FIG. 4 which forms the connection between loop carriage 2 and a support carriage 9 and between the support carriages 9. The cam drum 15 further includes a short cylindrical drum portion 22 adjacent the conical portion 21. The grooves 19 extend helically on the conical portion 21.

As an additional or a separate measure, the cam drum can be connected by means of a gear-type connection which includes a toothing 25 and a pinion 26 engaging a helically grooved pinion shaft 27 with a guiding device 28 for the traction rope 20 for guiding the traction rope as exactly as possible on the conical portion 21. This can be achieved, for example, by providing the guiding device 28 with an internal groove which corresponds to the pinion shaft 27, so that, when the cam drum or the pinion shaft 27 are rotated, the guiding device is displaced on the pinion shaft 27 by a predetermined distance. The cam drum and the pinion shaft may be supported by conventional means used in the art and are not illustrated in detail for simplicity's sake.

When the strip storage unit 1 is empty, the support carriages 9 and the loop carriage 2 are moved together in the region of the feed roller 6 or the run-out roller 7. In this position, the connecting traction rope 20 is completely wound onto the conical portion 21 of each individual support carriage. When the strip storage unit is being filled, the motor-driven rope winch 3 moves the loop carriage 2 against the braking torque of the torque motor 16 toward the rope winch 3. During this movement, the traction rope 20 is unwound from the cam drum by a certain length which corresponds to the distance of displacement of the individual support carriage 9. Since the torque motors 16 are of the same type in each support carriage, all support carriages 9 are pulled out against the same braking torque, so that, with respect to the point from which the loop carriage is moved, equal distances are formed between the support carriages 9. Accordingly, a rope traction means is provided which operates in dependence on the rope length. When the strip storage unit 1 is emptied, the loop carriage 2 is moved back, so that the traction rope connecting the loop carriage 2 and the support carriage 9 is untensioned.

Because of the torques developed by the torque motors, the untensioned and shortening traction rope 20 is wound onto the drum contour 23 by a length which corresponds to the decrease of the distance between the loop carriagae 2 and the support carriages 9. The undesigning of the traction rope between the loop carriage and the support carriage also leads to an undesigning of the traction rope between each support carriage 9. Because of the constant torque provided by the torque motor 16 of the individual support carriages 9, the untensioned and shortening traction rope between the support carriages is wound onto the individual cam drums. In this manner, when the strip storage unit is being emptied, always the same distance exists between the loop carriage 2 and the next support carriage 9 and between the support carriages 9, wherein the distance between the carriages is dependent on the position of the loop carriage.

While a specific embodiment of the invention has been shown and described in detail to illustrate the application of the inventive principles, it will be understood that the invention may be embodied otherwise without departing from such principles.

We claim:

1. A strip storage unit for a continuous operation of rolling mill trains, the strip storage unit comprising:

at least one feed roller and at least one run-out roller for a sheet metal strip, which are arranged at an inlet and an outlet of the strip storage unit, respectively;

a loop carriage having at least one deflection roller for a strip loop and movable on guide means for changing a loop length;

support carriages each having:

wheels with axes;

at least one support roller for guiding a strip; and at least one cam drum including a conical portion and arranged on a same level as the axes of the wheels of the support carriage;

a traction member for connecting the support carriages to the loop carriage, the traction member being wound onto and unwound from the conical portions of respective cam drums during movement of the loop carriage;

means for forming equal distances between the support carriages relative to a point from which the loop carriage is moved in all positions of the support carriages during movement thereof, said forming means comprising a plurality of torque motors of the same type, corresponding in number to a number of the support carriages, for applying an adjustable constant resistance torque to the cam drums of the support carriages, respectively, the torque motors being arranged on the same level as the axes of the wheels of respective support carriages; and means for supplying current to the torque motors, the current supplying means including a current-carrying rail, which is mounted in a foundation and between the guide means and with which the torque motors are in electrical contact.

2. The strip storage unit according to claim 1, wherein the traction member is a rope.

3. The strip storage unit according to claim 2, wherein the conical portion of the drum has helically extending grooves for receiving the rope.

4. The strip storage unit according to claim 2 comprising a guiding device for guiding the traction rope onto the conical portion of the drum, the guiding device being connected through a gear unit to the cam drum.

5. The strip storage unit according to claim 1, wherein the traction member is a chain.

6. The strip storage unit according to claim 1, wherein the cam drum includes a short cylindrical portion adjacent the conical portion.

* * * * *